United States Patent [19]

Reppas et al.

[11] Patent Number: 4,476,592

[45] Date of Patent: Oct. 16, 1984

[54] CONVERTIBLE FURNITURE WITH FORCE EQUILIBRIUM AND LATCH MECHANISM

[75] Inventors: George S. Reppas, Hillsborough; Gerrit K. Drexhage, San Francisco, both of Calif.

[73] Assignee: Optimum Space Systems, San Francisco, Calif.

[21] Appl. No.: 365,374

[22] Filed: Apr. 5, 1982

[51] Int. Cl.[3] ..... A47C 19/06

[52] U.S. Cl. ..... 5/164 B; 5/136; 5/167; 5/2 R

[58] Field of Search ..... 5/133, 136, 145, 164 B; 292/167, 2 R, 2 B, 166

[56] References Cited

U.S. PATENT DOCUMENTS

| | | | |
|---|---|---|---|
| 662,704 | 11/1900 | Tesch | 5/136 |
| 916,923 | 3/1909 | Edmonds | 5/167 |
| 940,038 | 11/1909 | Lyons | 5/107 |
| 1,094,684 | 4/1914 | Snyder | 5/167 |
| 2,020,035 | 11/1935 | Marchesand | 292/166 |
| 2,504,769 | 4/1950 | Watter | 5/167 |
| 2,715,542 | 8/1955 | Gould | 292/166 |
| 4,080,757 | 3/1978 | Westerman | 292/166 |
| 4,318,155 | 3/1982 | Reppas | 5/2 R |

*Primary Examiner*—Alexander Grosz
*Assistant Examiner*—Michael F. Trettel
*Attorney, Agent, or Firm*—Flehr, Hohbach, Test, Albritton & Herbert

[57] ABSTRACT

Convertible furniture comprising a bed frame pivotally mounted about a transverse axis between raised and lowered positions. Means is provided for applying a torque on the frame acting opposite to the force of gravity so that the forces are in substantial equilibrium in an intermediate arc of travel. In one embodiment a utility module such as a love seat is mounted with the frame through a parallelogram connection, and a latch mechanism is provided for releasable locking the frame in its horizontal position. In another embodiment a bed frame is pivotally mounted to move into a wall cavity, and a latch mechanism is provided for releasably locking the bed in either its raised or lowered positions.

2 Claims, 10 Drawing Figures

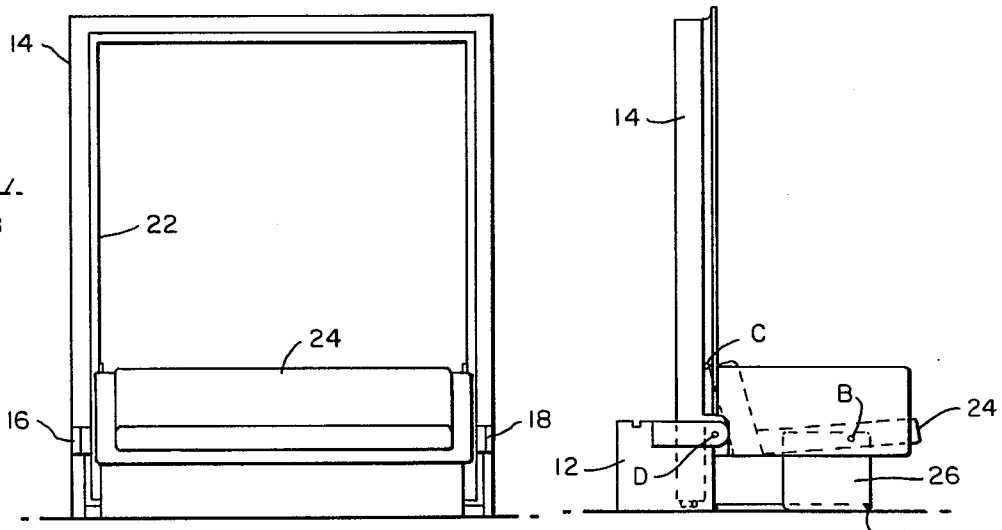
FIG.—3
FIG.—2
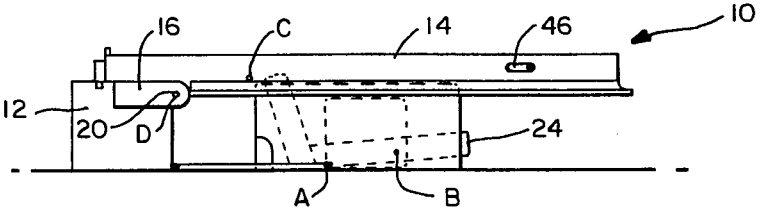
FIG.—4
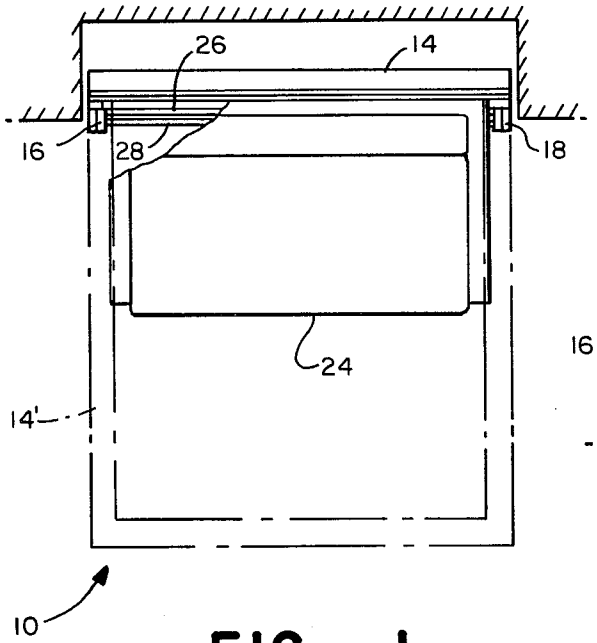
FIG.—1

CONVERTIBLE FURNITURE WITH FORCE EQUILIBRIUM AND LATCH MECHANISM

This invention relates to furniture which is convertible for different modes of use. More particularly, this invention provides improvements in furniture of the type which includes a convertible bed to achieve greater utility, convenience and ease of operation.

Various types of convertible furniture designs have been heretofor provided. Among these designs are the convertible sofabed, the Murphy or wall bed, and a combination bed which is convertible into a desk, table or dresser as in U.S. Pat. No. 4,070,715 issued to George S. Reppas.

Convertible furniture units of the type described have the objective of providing space economy, such as in apartments, offices, ships and other living accommodations where it is desired to economize on floorspace. However, among the shortcomings and limitations of these prior designs are that they are somewhat difficult to manually operate between the different modes of use. Additionally, many of these designs do not make provision for safely and effectively latching the units in their different modes.

It is, accordingly, a general object of the invention to provide new and improved convertible furniture incorporating a bed operating between different modes of use.

Another object is to provide furniture of the type described which can be safely and easily converted by manual operation between the different modes of use.

Another object is to provide convertible furniture of the type described which incorporates a force balancing feature by which a minimum of effort is required to initiate movement of the bed frame between its raised or lowered positions.

Another object is to provide a convertible bed frame and utility module incorporating a latch mechanism which releasably secures the bed frame in its lowered position.

Another object is to provide furniture of the wall bed design which includes a latch mechanism releasably securing the bed frame in both raised and lowered positions.

The invention in summary includes convertible furniture incorporating a bed frame pivotably mounted between raised and lowered positions. In one embodiment a utility module such as a loveseat is mounted through a parallelogram connection with the bed frame for movement into a raised position when the bed frame is raised. Torque means is provided for urging the bed frame and module toward the raised position with a force equilibrium being established between gravity acting on the unit and the torque means when the bed frame is intermediate its arc of travel. A latch mechanism is provided to releasably secure the bed frame in its lowered position so that, when released, the net moment is effective to immediately begin upward movement of the bed frame. In the embodiment of the wall bed design a latch mechanism releasably holds the bed frame in both raised and lowered positions.

The foregoing and additional objects and features of the invention will appear from the following description in which the preferred embodiments have been set forth in detail in conjunction with the company drawings.

FIG. 1 is a top plan view of the combination bed and utility module embodiment of the invention.

FIG. 2 is a front elevation view of the embodiment of FIG. 1 showing the raised position of the bed frame.

FIG. 3 is a side elevation view of the embodiment of FIG. 1.

FIG. 4 is a side elevation view of the embodiment of FIG. 1 showing the bed frame in its lowered position.

Figure 5:
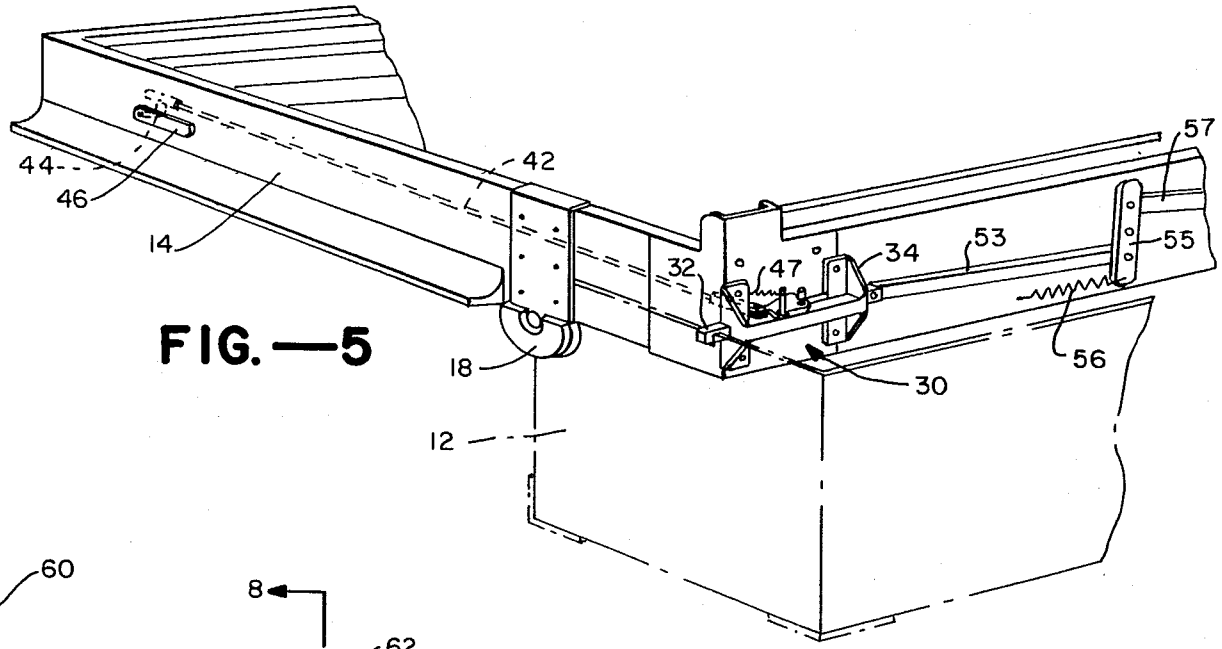
FIG. 5 is a perspective, fragmentary view of the embodiment of FIG. 1 illustrating details of the latch mechanism.

In the drawings FIGS. 1–4 illustrate generally at 10 a convertible furniture unit incorporating an embodiment of the invention which provides a combination bed frame and love seat. The furniture unit includes a base 12 which is mounted at the floor of a room, or which can project from a support or wall, such as in a compartment of a ship. A rectangular bed frame 14 is pivotably mounted through knuckles 16, 18 on opposite sides of the base for pivotal movement about a transverse axis 20 between the raised position shown in FIGS. 1–3 in which the frame is disposed in an upright orientation and the lowered position in which the frame is disposed in a horizontal orientation as shown in FIG. 4. The inner perimeter 22 of the frame is formed into a ledge to carry bedding.

Figure 10:
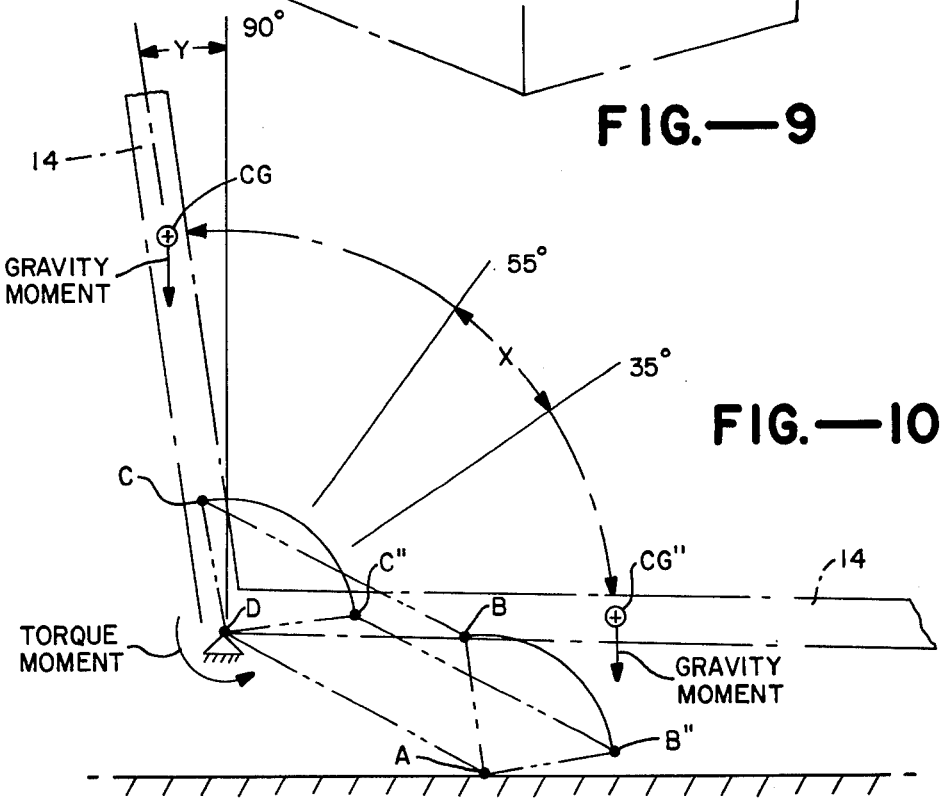
FIG. 10 is a schematic diagram illustrating the force equilibrium mechanism for the embodiment of FIG. 1.

A utility module 24 comprising a love seat is mounted with the bed frame for movement between the raised position of FIGS. 1–3 and the lowered position of FIG. 4 concurrent with movement of the bed between its respective raised and lowered positions. Alternatively the utility module could comprise other furniture such as a desk, dresser, credenza, or workbench and the like. The love seat or other utility module is mounted with the frame by pivot joints forming a parallelogram connection as illustrated in the schematic of FIG. 10. A support leg or plate 26 is pivotally connected on both sides with the forward end of the love seat. The pivot connection formed between the leg and base or floor is at the location indicated "A," while the pivot connection between the leg and seat is at "B." The pivot connections between the upper sides of the seat and bed frame is at location "C," while the pivot connections formed by the knuckles between the bed frame and base is at Location "D."

With the love seat and bed frame in their raised positions the parallelogram is enclosed by the pivot joints A-B-C-D of FIG. 10. In the lowered positions the parallelogram formed by the joints is at A-B″-C″-D.

When the bed frame and love seat are at their fully-lowered positions their combined weight (indicated as the point CG″) creates a positive force moment acting in a clockwise direction as viewed in FIG. 10. As the frame and seat are pivoted upwardly toward the 90° position of the frame the gravity force moment decreases as a function of the cosine of the included angle between the point CG and horizontal. The bed frame is moved through its final arc of travel to an over-center position beyond 90° vertical as indicated by the angle "Y". In the over-center position the combined center of gravity CG creates a negative force moment acting in a counter-clockwise direction as viewed in FIG. 10.

Means is provided for applying a negative torque on the bed frame acting in a counter-clockwise sense as viewed in FIG. 10. This torque means is created by a pair of elongate torsion bars 26, 28 mounted alongside the pivot axis 20 of the bed frame. The left-hand end of the torsion bar 26 (as viewed in FIG. 1) is fixed to the left of base 12 while the opposite end of the bar is fixed to the opposite end of the bed frame 14. The right-hand end of torsion bar 28 is fixed to the right side of base 12 while the opposite end of this bar is fixed to the left side of the bed frame. The torsion bars are set in their mountings so that a maximum negative moment is applied to the bed frame in its horizontal position, and the magnitude of this moment is greater than the magnitude of the positive moment from gravity acting on the frame and seat. A net negative moment is thereby created at the horizontal position urging the bed and seat toward the raised positions. The magnitude of the torque moment from the torsion bars decreases as a function of the arc of travel as the bed frame is raised. When the bed frame is in an intermediate arc of travel in the range of 35° to 55°, indicated as "X" in FIG. 10, the positive moment from gravity is substantially equalized by the negative torque moment. In this intermediate arc the forces are in substantial equilibrium so that a person can easily move the bed frame in either direction, and with the drag forces from the pivot joints the bed frame can even come to rest within this intermediate arc. As the bed frame continues to travel upwardly beyond the intermediate arc the torsion force decreases faster than the decrease in the gravity moment so that the net moment becomes positive until the 90° position is reached. This positive net moment assists downward movement of the bed frame and seat when the unit is being converted to the bed mode. When the bed frame is pivoted backward beyond the 90° position through the arc "Y" the gravity moment predominates so that the net moment is negative for holding the unit in the overcenter raised position.

Figure 6:
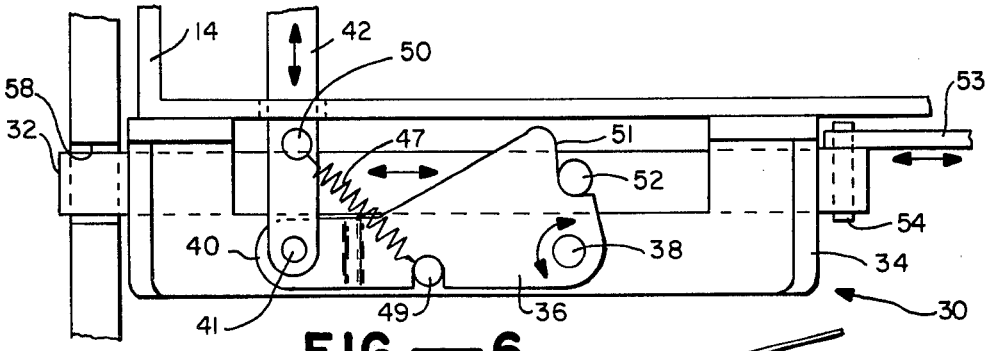
FIG. 6 is a top plan view, to an enlarged scale, of a sub-assembly of the latch mechanism shown in FIG. 5.

Latching means is provided for latching the unit in its lowered or bed mode of use. The latch means includes a pair of latch mechanisms 30 mounted on opposite sides of the distal end of bed frame 14. The latch mechanism 30 illustrated in FIGS. 5 and 6 is typical of the two mechanisms. Mechanism 30 includes a lock bolt 32 mounted in a frame 34 for lateral sliding movement between extended and retracted positions by means of an actuating cam 36. The cam is pivotally mounted on frame 34 through a pivot joint 38. One arm 40 of the cam is pivotally mounted at a joint 41 to the end of an actuating rod 42 which extends along the length of a side of frame 14. The opposite end of rod 42 is connected to a lever carried on a shaft 44 which is operated by a latch actuating handle 46 carried on the outside of the frame. Return spring 47 is mounted between a post 49 on the frame and a post 50 on rod 42 for returning cam 36 and operating handle 46 to the home positions shown in FIGS. 5 and 6. The camming surface 51 of cam 36 acts against a post 52 on the lock both to move the bolt to its retracted position when handle 46 is turned up and cam 36 is thereby pivoted clockwise, as viewed in FIG. 6.

One end of a drag rod 53 is mounted by a pin 54 to the inner end of the lock bolt, and the other end of the rod 53 is pivotally mounted on a slave bell crank 55 supported on the end of the bed frame. A spring 56 urges the slave bell crank in a clock-wise direction as viewed in FIG. 5. A second drag rod 57 is pivotally mounted on the opposite end of bell crank 55, and the other end (not shown) of rod 57 is mounted in a similar means for operating the lock bolt in the latch mechanism on the opposite side of the bed frame. A slot 58 is formed on the upper edge of base plate 12 to act as a detent for seating the lock bolt when in its extended position.

In the operation of the latch mechanism 30 the spring 56 urges bell crank 55 in a direction to normally move the drag rods 53, 57 outwardly of the bed frame and thereby pivot the cam 36 counter-clockwise as viewed in FIG. 6 for urging the lock bolts 32 outwardly toward their extended positions. With the bed frame in its lowered position as shown in FIG. 5 the extended lock bolts seat in slots 58 and hold the frame from upward movement against the net moment due to the torque of the torsion bars. When a person desires to convert the unit to the love seat mode, an actuating handle 46 on either side of the bed frame is pivoted upwardly to move actuating rod outwardly 42 along the length of the frame. This in turn pivots cam 36 clockwise as viewed in FIG. 6 to move lock bolt 32 toward its retracted position out of engagement with slot 58. At the same time drag rod 53 is moved inwardly by the cam to pivot slave bell crank 55 against the force of spring 56 and thereby move rod 57 inwardly to cause retraction of the lock bolt on the opposite side of the frame. With both lock bolts disengaged the net moment is immediately released for urging the bed frame upwardly so that the operator need not exert any substantial force on the bed frame. When the unit is again converted back from the seat mode to the bed mode the pivotal movement of the bed carries the lock bolts into alignment with the slots 58 at the base so that the action of spring 56 through the drag rods permits the lock bolts to automatically extend and seat in the slots for latching the frames.

Figure 8:
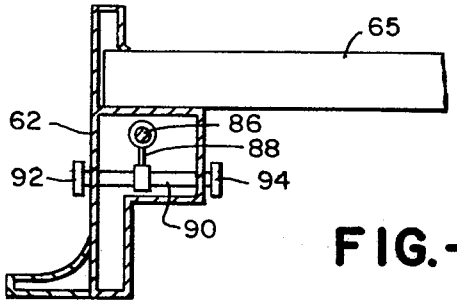
FIG. 8 is a cross-sectional view taken along the Line 8—8 of FIG. 7.
Figure 7:
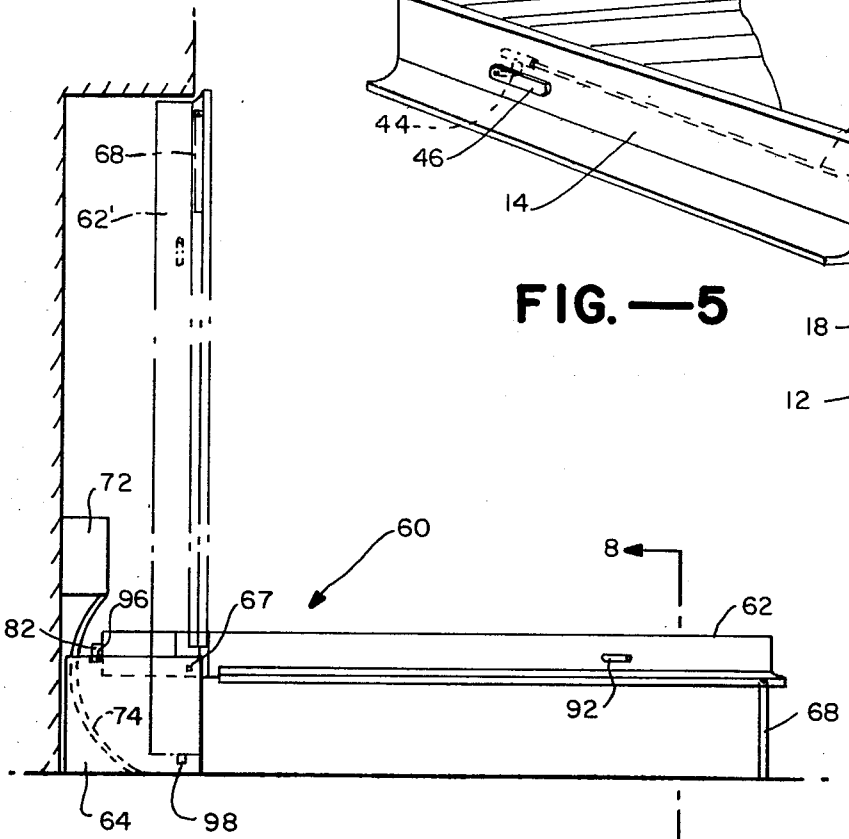
FIG. 7 is a side elevation view of another embodiment of the invention.
Figure 9:
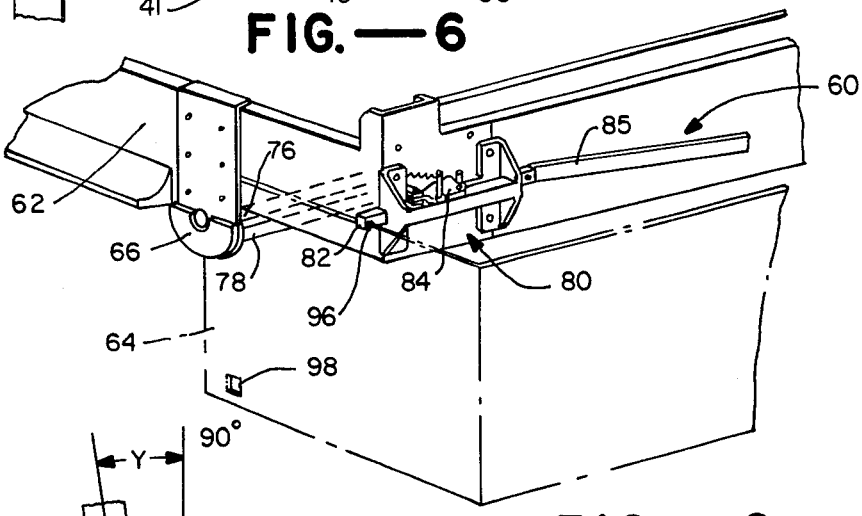
FIG. 9 is a perspective, fragmentary view showing the latch mechanism for the embodiment of FIG. 7.

Another embodiment of the invention providing a convertible furniture unit 60 of the wall bed design is illustrated in FIGS. 7–9. Unit 60 includes a bed frame 62 mounted on a base 64 through knuckles 66 for pivotal movement about a transverse axis 67 between a raised position in which the frame 62 which it carries are disposed in an upright orientation (shown in dashed time in FIG. 7) and a lowered position in which the frame and bedding are in a horizontal orientation. The bedding 65 is mounted within the frame in the manner shown in FIG. 8. A support leg or plate 68 is pivotally mounted at the distal end of the frame for supporting the end of the frame when in the lowered position for use in the bed mode. In the raised position the leg pivots against the frame in the retracted position 68' of the FIG. 7. The base 64 is mounted at the lower end of a cavity 70 formed within the wall of a room. A head board 72 is mounted within the cavity for use in the bed mode, and a curved plate 74 is mounted below the head board for use as a pillow cavity when the bed frame is raised.

Torque means is provided for applying a negative moment on the bed frame in a counterclockwise direction as viewed in FIG. 7. The torque means comprises a pair of torsion bars 76, 78 arranged in the manner described for the embodiment of FIG. 1. This negative torque moment acts against the positive gravity moment acting on the frame when the frame is pivoted away from its raised position. In a manner similar to that described for the embodiment of FIG. 1, the torque moment from the torsion bar is at a maximum when the frame is horizontal so that the net moment acting on the frame is negative whereby the frame is normally urged upwardly, when unlatched, from the horizontal position. The gravity moment decreases as a function of the cosine of the angle of the bed frame. The torque moment decreases at a faster rate so that when the frame is at the intermediate arc in the range of 35° to 55° the forces are in substantial equilibrium and minimum force is required by the operator to move the frame in either direction. During further upward travel of the frame the gravity moment predominates so that a net positive moment is established up to the 90° position. When the frame is unlatched from its raised position this net positive moment assists in moving the frame downwardly.

Latching means is provided for latching the bed frame in both the raised and lowered position. The latching means includes a pair of latch mechanisms 80 on opposite sides of the distal end of the bed frame of which the typical mechanism 80 is shown in FIGS. 8 and 9. The latch mechanisms are similar in construction and operation to the mechanism 30 described in connection with FIGS. 5 and 6. The mechanism 80 includes a lock bolt 82 which is operated by a cam 84 between extended and retracted position. The cam in turn is operated by an actuating rod 86 (FIG. 8) mounted along opposite sides of the frame. A drag rod 85 connects through a spring-loaded slave bell crank, not shown, and a second drag rod with the latch mechanism on the opposite side of the frame. The actuating rod is operated through a lever 88 connected to a shaft 90 having ends which project on either side of the bed frame. Operating handles 92, 94 are carried on opposite ends of each shaft. On each side of the base a slot 96 is formed along the upper edge to act as a detent for seating the bolt 82 when in its extended position and thereby holding the frame in its horizontal position. Also on each side of the base an opening 98 is formed in alignment below the knuckles, and this opening seats the extended bolts when the frame is in its raised position for lockiong the frame against downward movement.

The bed frame 62 is unlatched from its lowered position by upward pivoting of either of the handles 92 which are on the outside of the frame. This moves the associated actuating rod 86 outwardly for operating the cam and drag rod mechanism to retract the bolts 82 from the respective slots 96. The net negative moment urges the frame upwardly without requiring assistance by the user until the frame moves beyond the arc of force equilibrium. When at the upright position the bolts are urged by spring action to their extended positions engaging opening 98 to thereby automatically lock the frame upright. To release the frame for converting back to the bed mode the person pivots either of the handles 94 on the inside of frame 62 to again retract the bolts. The net positive moment acting on the frame urges it downwardly and through the arc of force equilibrium, following which a slight downward force by the user carries the frame to horizontal so that the bolts again automatically lock by engaging with slots 96.

While the foregoing embodiments are presently considered to be preferred it is understood that numerous variations and modifications may be made therein by those skilled in the art and it is intended to cover in the appended claims all such variations and modifications as fall within the true spirit and scope of the invention.

What is claimed is:

1. Convertible furniture comprising a base, a bed frame for holding bedding, means forming a wall cavity, means for carrying the frame at one of its ends for pivotal movement on the base about a transverse axis between a raised position in which the frame and bedding are disposed in an upright orientation within the wall cavity and a lowered position in which the frame and bedding are disposed in a horizontal orientation, a utility module comprising a frame for holding a seat, desk, credenza, chest or workbench and the like, pivot joint means forming on each side of the furniture a parallelogram connection between the frames of the bed, the base and utility module whereby the utility module frame is carried between raised and lowered position conjointly with movement of the bed frame between respective raised and lowered positions, with the points of connection of the pivot joints being established so that when the frames are away from their raised positions their combined weight acts as a gravity moment urging the frames toward their lowered positions, and means for applying a torque moment on the frames when away from the raised positions, said torque moment being applied in a sense opposite the gravity moment with a magnitude which progressively decreases from a maximum with the bed frame in its lowered position and a minimum with the bed frame in its raised position, with the torque moment substantially cancelling the gravity moment when the bed frame is within an arc of 35°to 50° between the raised and lowered positions and with the torque moment being greater than the gravity moment when the frames are in their lowered positions creating a positive net moment urging the frames upwardly, said latch means including at least one lock bolt carried at the proximal end of the bed frame together with actuating means for moving the lock bolt between extended and retracted positions, means for engaging the lock bolt in its extended position for releasably holding the bed frame in its raised position, said lock bolt being mounted for sliding movement transversely of the bed frame, said means for engaging the bolt comprising a detent opening on the base of the furniture, said actuating means comprising at least one actuating rod extending along a side of the bed frame, means for operably interconnecting an end of the actuating rod with the lock bolt, actuating handle means carried on the distal end of the bed frame for operating the actuating rod, said handle means including a first handle mounted on the outerside of the bed frame and operatively coupled with the actuating rod, with the first handle being accessible to an operator when the bed frame is in its lowered position, the handle means further including a second handle mounted in the inside of the bed frame and operatively coupled with the actuating rod, with the second handle being accessible to an operator when the bed frame is in its raised position.

2. Convertible furniture as in claim 1 in which the pivot points of connection between the frames in the parallelogram connection establishes the centers of gravity of the frames when in their raised position overcenter the pivot joints whereby the gravity moment acts in a sense holding the frames in the upright orientations.

* * * * *